US005753048A

United States Patent [19]

Lippold et al.

[11] Patent Number: 5,753,048

[45] Date of Patent: May 19, 1998

[54] METHOD AND APPARATUS FOR CLEANING A CYLINDER OF A ROTARY PRINTING MACHINE

[75] Inventors: Andreas Lippold, Nidderau; Marco Bergmann, Rodgau; Joachim Olek, Obertshausen; Andreas Lüder, Bruchkobel; Roland Holl, Weiterstadt, all of Germany

[73] Assignee: MAN Roland Druckmaschinen AG, Germany

[21] Appl. No.: 568,370

[22] Filed: Dec. 6, 1995

[30] Foreign Application Priority Data

Dec. 6, 1994 [DE] Germany ..... 44 43 356.5

[51] Int. Cl.[6] ..... B08B 7/04; B41F 35/00

[52] U.S. Cl. ..... 134/18; 134/6; 101/425; 101/423

[58] Field of Search ..... 101/425, 423; 134/18, 6

[56] References Cited

U.S. PATENT DOCUMENTS 5,010,819 4/1991 Uribe et al. ..... 101/425

FOREIGN PATENT DOCUMENTS 0 004 605 10/1979 European Pat. Off. .
0 419 289 A3 8/1991 European Pat. Off. .
0 548 500 A1 10/1992 European Pat. Off. .
AS 1 808 909 3/1974 Germany .
26 13 687 5/1979 Germany .
41 42 422 A1 6/1993 Germany .
42 16 243 A1 11/1993 Germany .
43 43 692 A1 6/1995 Germany .

OTHER PUBLICATIONS

Uncertified English translation of DE4216243 AI, (No Date).

*Primary Examiner*—Jill Warden
*Assistant Examiner*—Alexander Markoff
*Attorney, Agent, or Firm*—Leydig, Voit & Mayer, Ltd.

[57] ABSTRACT

A method and an apparatus for cleaning a rotating cylinder of a rotary printing machine. The apparatus having a washing device, including a washing brush, roller, or cloth, which can be engaged and disengaged from the rotating cylinder to be cleaned. The washing brush roller or cloth can be sprayed with a cleaning fluid (detergent, water) as well as both water. The method and apparatus ensure a controlled guiding of the detergent onto the outer surface of the rotating cylinder, which guarantees an effective cleaning and, at the end of the washing operation, leaves a relatively dry outer surface of the rotating cylinder. The cleaning method is intended to be suitable, in particular, for detergents having a biological base, for example, esters of vegetable oil. Effective cleaning and drying with minimal waste is achieved in that the washing device is controlled, depending on fixed angular settings, with a washing cycle or a drying cycle, giving due regard to the rotary speed and direction of rotation of the respective rotating cylinder to be cleaned. The apparatus for carrying out the cleaning method essentially comprises an angle generator which is connected to a controller which, in turn, is coupled to the washing device, specifically, the operating cylinders and the spraying nozzles.

17 Claims, 6 Drawing Sheets

METHOD AND APPARATUS FOR CLEANING A CYLINDER OF A ROTARY PRINTING MACHINE

BACKGROUND OF THE INVENTION

1. Field of the Invention

The present invention relates to a method and apparatus for cleaning a cylinder of a rotary printing machine, and more particularly, to a method and apparatus for cleaning printing cylinders, including blanket cylinders and back pressure cylinders as well as plate cylinders or form cylinders, for example, in a varnishing unit.

2. Discussion of the Related Art

A method for cleaning a plate cylinder is disclosed in DE-B 1 808 909. In this disclosure, in order to achieve a wiping effect for removing soil and other deposits such as ink, varnish residues, and dust on the plate cylinder, a roller which rests against the plate cylinder is driven at a different radial speed from that of the plate cylinder.

A washing device which is mounted in a rotary joint and which has a washing roller is disclosed in EP 0.004.605 A1. The washing device has a control cam in the region of a gripper of an impression cylinder. By means of this control cam, the washing roller which is engaged against the impression cylinder is lifted up from the outer surface in an angular motion so that it does not collide with the grippers.

It is also known from EP 0.548.500 A1 that an accumulation of fluid, consisting of detergent and removed soils, such as ink and dust, forms at the point of contact between the washing roller and the impression cylinder. The accumulation of fluid at this point of contact is pushed along in front of the washing roller in the direction of rotation and, when passing through the cylinder gap, is conveyed into the cylinder gap, which leads to the reduction or elimination of the accumulation of fluid. In this case, the washing roller can be pressed against the outer surface of the cylinder with variable force.

The above described cleaning methods and devices have certain disadvantages associated therewith in that the hydrodynamic conditions and the frictional engagement at the point of contact between the washing roller of the washing device and the particular cylinder to be cleaned, are given too little attention. Thus, at the end of the cleaning operation, there is often a residual layer of fluid over the entire outer surface of the cylinder, i.e., the outer surface of the cylinder is not yet sufficiently dry when subsequent printing begins. This situation occurs, in particular, in the case of detergents which do not contain rapidly evaporating solvents, for example, detergents formed from a vegetable base. Furthermore, there is the risk that detergents or even water may pass into the cylinder gap due to the spraying effect of nozzles utilized to deliver the detergents and water or even due to the washing device itself.

The transporting of excess detergent (including soil and other deposits) into the cylinder gap in accordance with EP 0.548.500 A1 also has a disadvantage associated therewith in that the printing quality of the sheets in the subsequent printing cycle is lowered. The excess detergent in combination with the removed soils and other deposits forms a sludge which collects in the cylinder gap with the heaviest concentrations collecting at the edge of the cylinder gap which is arranged at the beginning in relation to the direction of rotation of the printing machine. The use of excess detergent increases the consumption of detergent unnecessarily without improving the quality of the cleaning job itself. Additionally, an uncontrolled supply of detergent can lead to the washing device floating, e.g., hydroplaning, on the outer surface of the cylinder thereby inhibiting efficient cleaning.

A blanket cylinder which has flattened portions in the cylinder gap on both sides of the gap edges is disclosed in DE 2 613 687 B2. A cylinder of this type poses certain unique cleaning difficulties for known washing devices.

SUMMARY OF THE INVENTION

The object of the present invention is to develop an angle-controlled method and an apparatus for the controlled guiding of cleaning fluid, in particular, for detergents formed from a biological base, for example, esters of vegetable oil, on an outer surface of a cylinder. The angle-controlled cleaning method of the present invention guarantees an effective cleaning and, at the end of the washing operation, a relatively dry outer surface of the cylinder.

In accordance with a first aspect, the present invention is directed to a method for cleaning a rotating cylinder of a rotary printing machine. The method comprises engaging and disengaging a washing device, including a washing brush which can be sprayed with at least one of a cleaning fluid and water, with or from the rotating cylinder, and controlling the washing device. The washing device is controlled based upon fixed angular settings of the rotating cylinder, the rotary speed of the rotating cylinder, the rotation direction of the rotating cylinder, and whether the washing device is washing or drying.

The present invention is directed to a method and apparatus for cleaning the cylinder or cylinders of a rotary printing machine. The method and apparatus of the present invention ensures that the friction of movement is always present at the point of contact between the washing device and the outer surface of the cylinder to be cleaned. The friction of movement at the point of contact is in the form of mixed friction. Mixed friction is the combination of solid and fluid friction. Accordingly, the effect of floating (aquaplaning) of the washing device on the outer surface of the cylinder in the case of too much detergent may therefore be avoided. In addition, the consumption of detergent is thereby reduced and, at the end of the cleaning operation, the outer surface(s) of the cylinder are relatively dry. An optimum washing result is achieved even when using detergents formed from a biological base, in particular vegetable esters, since the outer surface of the cylinder is dry at the end of a washing operation. The method and apparatus of the present invention substantially prevents fluids from entering the cylinder gap. Accordingly, since the cylinder gap is, to the greatest extent possible, kept free from detergent, water and soil deposits, the quality of the sheets in a subsequent printing cycle or run is also improved.

The angle-dependent cleaning method and apparatus is particularly well suited for plate cylinders, blanket cylinders, back pressure cylinders, and form cylinders, in particular, for varnishing units. The method and the apparatus of the present invention are likewise particularly well suited for washing devices having washing rollers, for example, a washing brush or a roller with a soft outer surface (rubber or textile covering) or having a washing cloth which is operatively connected to a pressing-on element. All of the control operations of the washing device take place at specific predetermined angular settings of the printing machine or of the cylinder to be cleaned. A further advantage of the angle-controlled cleaning method and apparatus of the present invention is that detergent or water is prevented from entering the cylinder gap due to uncontrolled spraying. In an environmentally friendly manner, this reduces the consumption of detergent and water since the total outer surface of the cylinder does not have to be cleaned.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE PREFERRED EMBODIMENTS

Figure 1:
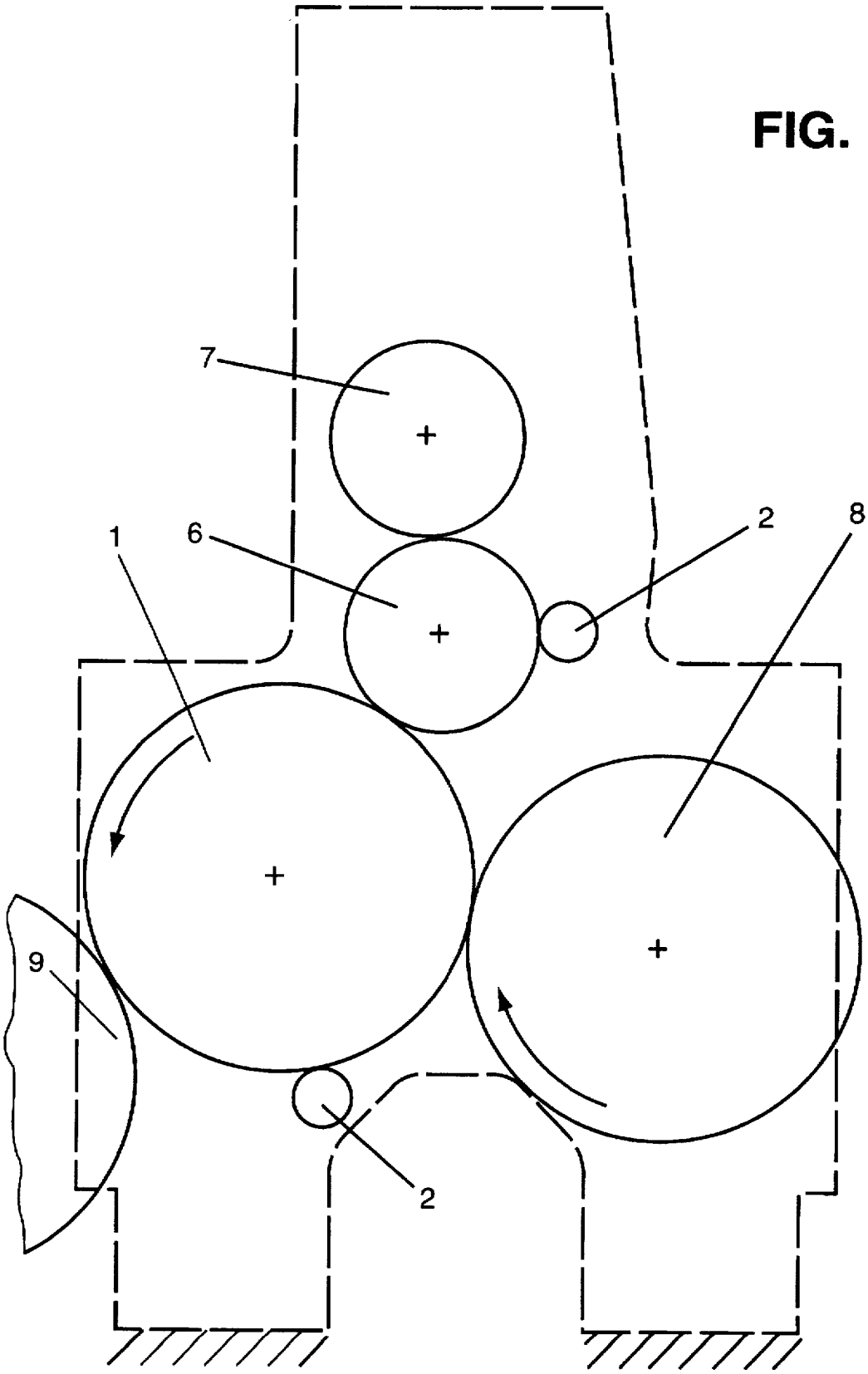
FIG. 1 is a diagrammatic representation of a printing unit of rotary printing machine.

FIG. 1 illustrates a printing unit of a multi-color rotary printing machine. The printing unit comprises a transfer drum 8 and an impression cylinder 1 which is positioned downstream, i.e., in the sheet-transporting direction of the transfer drum 8. In a known manner, a blanket cylinder 6 is positioned adjacent to the impression cylinder 1, and a plate cylinder 7 is positioned adjacent to and in contact with the blanket cylinder 6. The plate cylinder 7 has a damping unit and an inking unit, which are not shown here. Positioned downstream of the impression cylinder 1 is a receiving drum 9 which, in a known manner, takes a sheet of paper from the impression cylinder 1 and transports it to a delivery unit not shown. Separate washing devices 2 communicate with both the blanket cylinder 6 and the impression cylinder 1. Each washing device 2 extends over the full width of the cylinders 1, 6.

Figure 2:
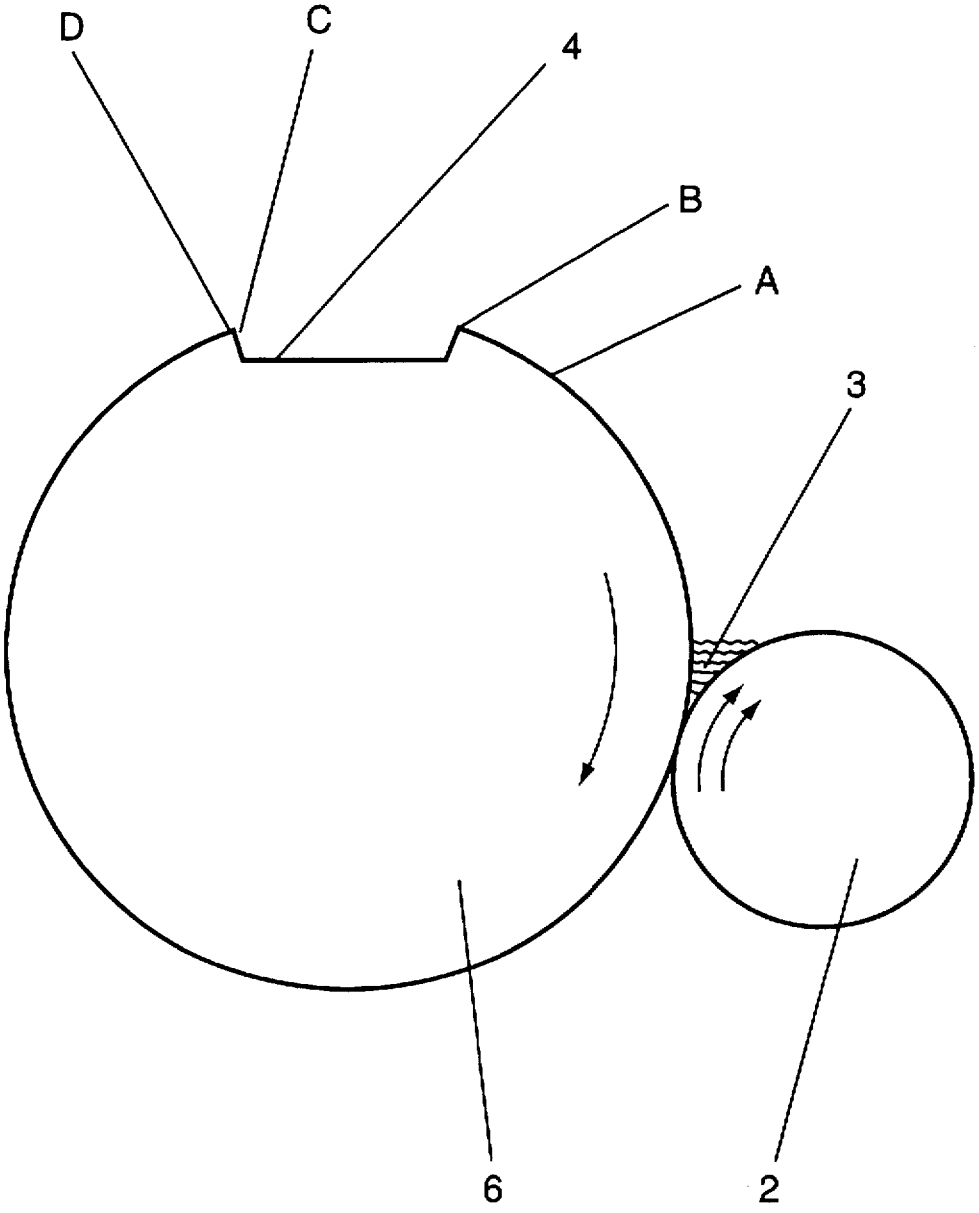
FIG. 2 is a diagrammatic representation of a washing roller in contact with a cylinder.
Figure 5:
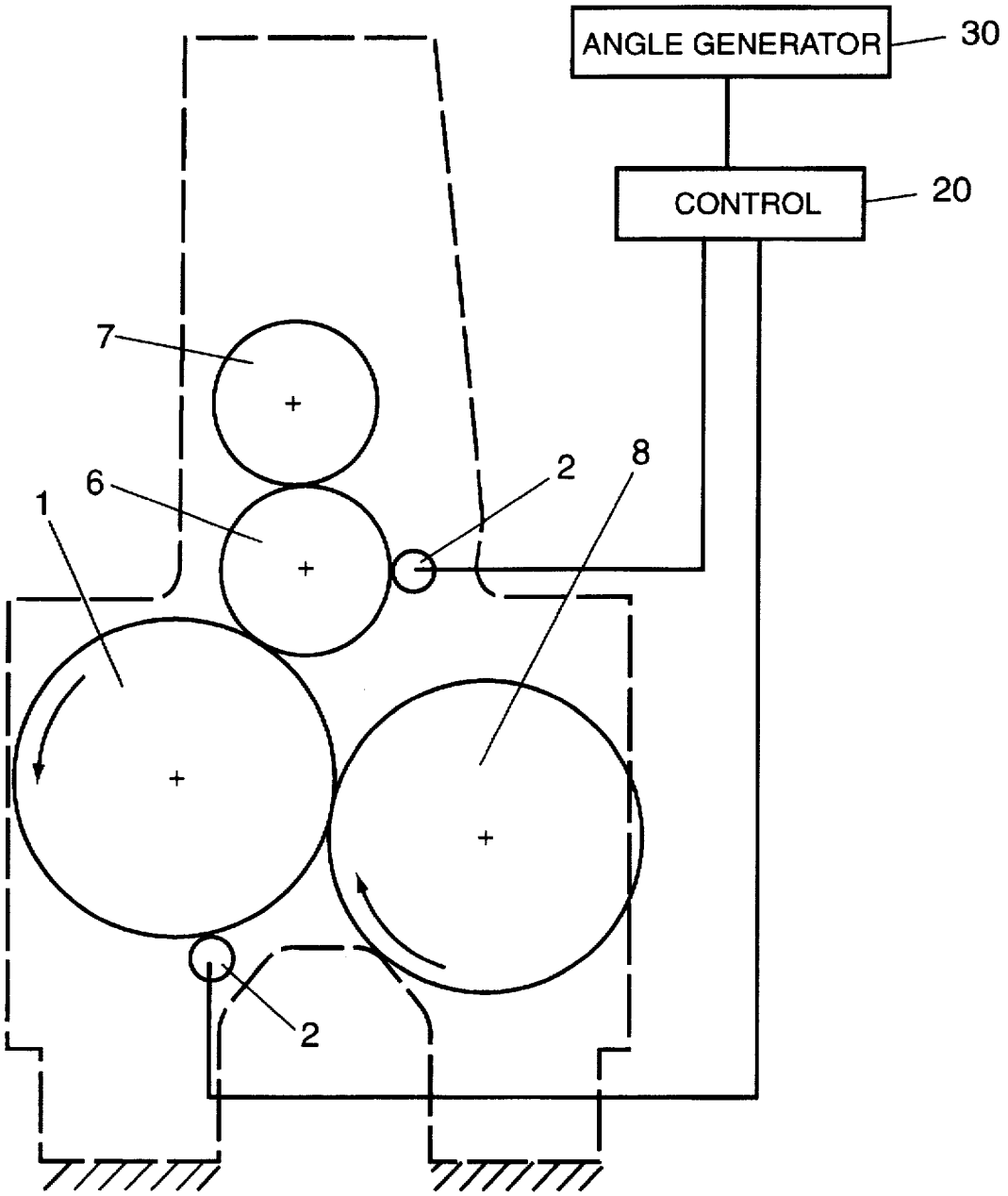
FIG. 5 is a diagrammatic representation of a printing unit having an angle generator and controller.
Figure 6:
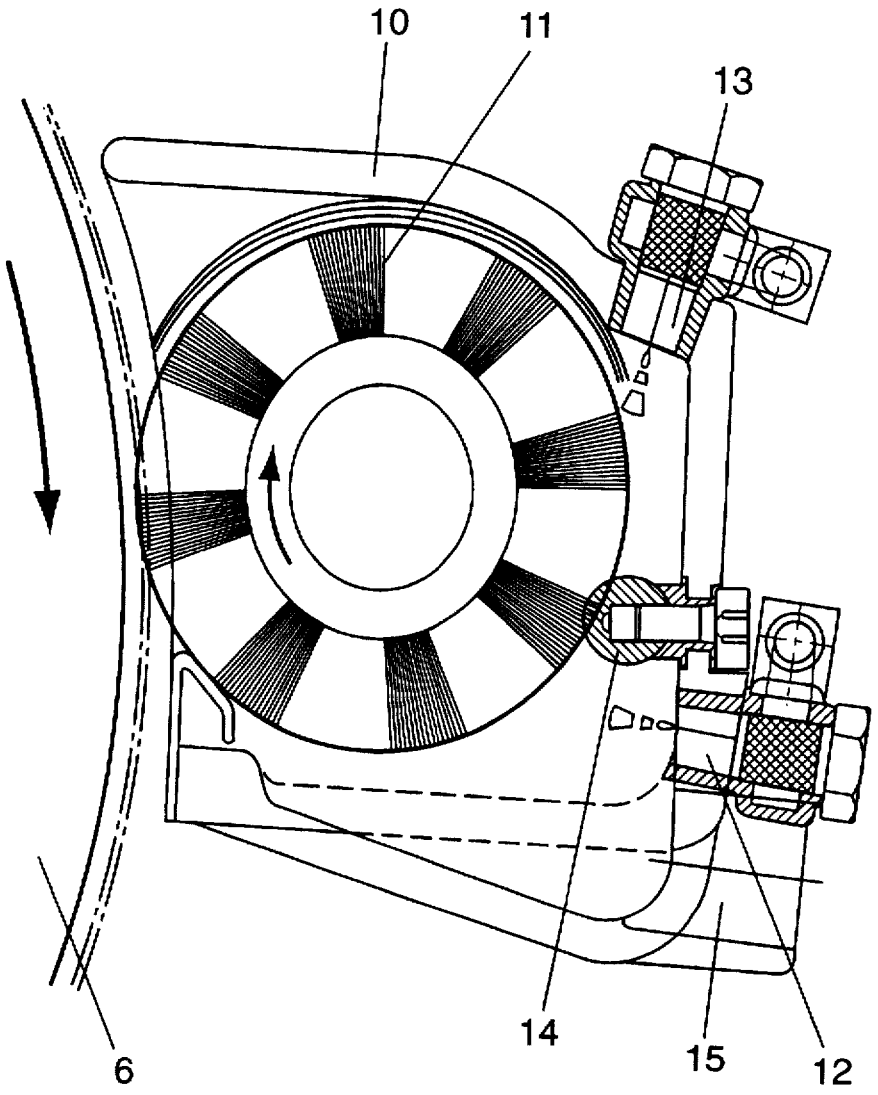
FIG. 6 is a detailed schematic representation of the washing device of the present invention.

FIG. 6 is a schematic representation of the washing device 2. Each washing device 2 comprises a housing 10 having a washing brush 11 contained therein. The washing brush 11, which may be a roller or any other suitable means for cleaning, is coupled to its own drive mechanism (not illustrated). Each washing device 2 also includes operating cylinders for engaging and disengaging the washing brush 11 from the respective cylinder to be cleaned. Arranged on the housing 10 of each washing device 2 is a detergent supply and nozzle 12 and a water supply and nozzle 13 directed onto the washing brush 11 and a doctor blade or wiper 14 which is in constant engagement with the washing brush 11. Provided at the lowest point of the housing 10 is a drain 15 for the cleaning fluid 3 which collects between the cylinder to be cleaned and the washing device 2, as illustrated in FIG. 2. The washing device 2 with its operating cylinders and its detergent supply and nozzle 12 and water supply and nozzle 13 is connected by circuitry to a controller 20 which, in turn, is coupled by circuitry to an angle generator 30 (FIG. 5). The controller may be an adaptive controller, e.g., a learning controller, which learns from experience. The angle generator 30 is preferably implemented utilizing a real-time computer which implements the angle-controlled cleaning process of the present invention. A sensor may also be utilized as an angle generator 30. The angle generator 30 serves to trigger all the control operations for each washing device 2 (actuation of the spraying nozzles 12, 13 and actuation of the operating cylinders) at predetermined angular settings, giving due regard to the cylinder setting, i.e., the cylinder gap 4 position and the circumferential speed of the cylinder to be cleaned. In the present invention, the control operations implemented by the controller 20 may be summarized as follows in the table given below:

TABLE

| | |
|---|---|
| $ | dampening/spraying the washing brush, including metering of detergent/water |
| $ | engagement and disengagement of the washing device |
| $ | controlling the circumferential speed of the washing brush |
| $ | stopping the washing brush |
| $ | controlling the direction of rotation/reversal of direction of rotation of the washing brush |
| $ | controlling the circumferential speed of the cylinder |
| $ | controlling the directions of rotation of the cylinder |
| $ | switching on and switching off the doctor blade pressure |

Figure 3:
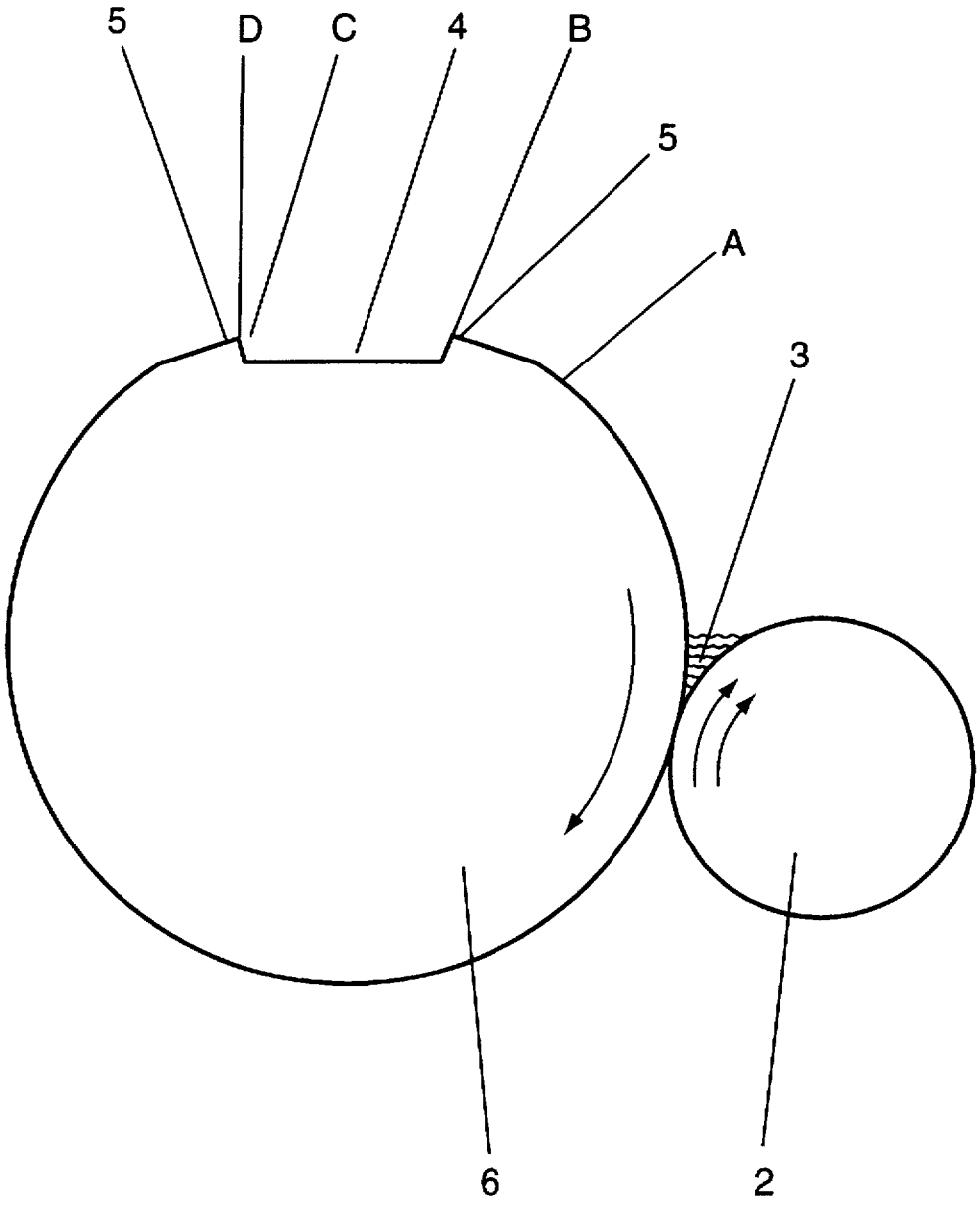
FIG. 3 is a diagrammatic representation of a further design of the washing roller in contact with a cylinder of FIG. 2.

In accordance with the exemplary angle-controlled cleaning process of the present invention, with each cylinder revolution, the washing brush 11 is sprayed with a detergent formed from an ester of vegetable oil or water via nozzle 12 or nozzle 13. On completion of the cleaning of the cylinder with detergent, which may last a plurality of cylinder revolutions, rinsing with water via nozzle 13 takes place selectively for at least one cylinder revolution. The spraying of detergent or water preferably takes place before the washing device 2 is engaged against the impression cylinder 1 so that no detergent or water is supplied during the contact of the washing device 2 with the impression cylinder 1. Rather, the cleaning fluid 3, as illustrated in FIG. 3, is merely guided as a wedge in front of the washing brush 11. In this procedure, with one cylinder revolution the quantity of detergent in the region of the end of the print region is greatly reduced.

On completion of the washing cycle, the drying cycle is initiated and the rotary speed of the cleaned cylinders is increased. The drying of the cylinder surface is thus accelerated. Any droplets still remaining, in particular at the edges of the cylinder gap, are flung off due to the centrifugal force developed by the increased rotary speed. This accelerated drying contributes to reducing the start-up waste.

The angle-controlled cleaning method consists of both a washing operation and a drying operation. The angle generator 30 monitors the angular position of the particular cylinder to be cleaned and outputs trigger signals to the controller 20. The controller 20, based upon these trigger signals, controls the operation of the washing device 2. The angular settings or positions may be manually or automatically adjustable. A complete description of the process is given below with respect to FIGS. 2–4.

At an angular setting C of the blanket cylinder (in front of the cylinder gap 4 in the direction of rotation), the washing device 2 is activated. Upon activation, the washing brush 11 is sprayed with detergent via the detergent supply and nozzle 12. The washing device 2 is then engaged against the blanket cylinder 6 at an angular setting D which corresponds to the first edge of the cylinder gap 4 (start of the cylinder gap 4). Starting from the angular setting D, the washing brush 11 of the washing device 2 remains in contact with the outer surface of the blanket cylinder 6 during a rotary movement thereof until an angular setting A is reached. The angular setting A is bounded by the region of the end of the printing sheet (depending on size) and the angular setting B (corresponding to the second edge) of the cylinder gap 4. During the time in which the washing brush 11 of the washing device 2 is in contact with the outer surface of the blanket cylinder 6, a wedge of cleaning fluid 3 including detergent and/or water is formed. The wedge of fluid 3 is guided along in front of the washing brush 11 on the outer surface of the blanket cylinder 6 in a circular sector formed by the angular settings D and A. At the angular setting A, the washing device 2 with the washing brush 11 is disengaged from the blanket cylinder 6 and the wedge of fluid 3 is deposited on the remaining portion of the outer surface of the blanket cylinder 6 in a circular sector formed by the angular settings A and B, and distributed over the surface by the rotary movement of the blanket cylinder 6. During the washing operation, the blanket cylinder 6 is constantly rotated; accordingly, the cylinder gap 4 also passes by the washing device 2, but without contact. In the region of the angular setting C, the washing brush 11 is again sprayed with detergent, and at the angular setting D, the washing brush 11 is engaged against the blanket cylinder 6. At the angular setting A, the washing brush 11 is disengaged and the wedge of fluid 3 is once again deposited and distributed over the portion of the outer surface of the blanket cylinder 6, in the circular sector formed by angular settings A and B. This angle-controlled washing operation can be carried out repeatedly. In addition, the blanket cylinder 6 may be cleaned with water before or after the end of washing with detergent at the angular settings described above, and the water likewise being deposited, distributed over a portion of the outer surface of the blanket cylinder 6, in the circular sector formed by angular setting A and B.

During the drying operation, the washing brush 11 of the washing device 2 is no longer sprayed with detergent or water, but is preferably constantly wiped during its rotation. The washing brush 11 is again engaged against the rotating blanket cylinder 6 at the angular setting D, and remains against the blanket cylinder 6 beyond the angular setting A up to the angular setting B. In this case, the deposited fluid (detergent and water) is picked up by the rotating washing brush 11 in the region of the outer surface of the circular sector formed by the angular settings A and B. In an alternative embodiment, the washing brush 11 can also remain disengaged in the circular sector formed by the angular settings D and A and be engaged against the outer surface after the angular setting A until the angular setting B is reached and thus merely pick up the deposited fluid. The rotating washing brush 11 of the washing device 2 has a higher circumferential speed compared to the blanket cylinder 6. In the circular segment of angular settings A and B, the washing brush 11 can maintain its direction of rotation, or the washing brush 11 may undergo a reversal of the direction of rotation. It is also possible for the movement of the washing brush 11 to be stopped. The stopping of the washing brush 11 has the equivalent effect of a doctor blade on the outer surface of the rotating blanket cylinder 6. The washing device 2 is moved out of engagement with the outer surface in the region of the cylinder gap 4, so that virtually no sludge (detergent, water, ink/varnish residues, soil, dust) can be conveyed into the cylinder gap 4, nor can it build up at the edge of the gap 4.

In cylinders having flattened portions 5 at the cylinder gap 4, as illustrated in FIG. 3, the washing device 2 does not have to be disengaged at the angular setting A. The wedge of fluid 3 is guided along in front of the washing brush 11 and deposited on the flattened portion 5. When the outer surface of the blanket cylinder 6 is brushed dry, the washing brush 11 of the washing device 2 is brought into contact with the flattened portion 5 approximately after the angular setting A. As a result, the deposited fluid 3 is picked up by the washing device 2. In this case, the washing brush 11 can likewise maintain its direction of rotation, stop, or carry out a reversal of direction of rotation. In the region of the cylinder gap 4, the washing device 2 is disengaged from the blanket cylinder 6.

Figure 4:
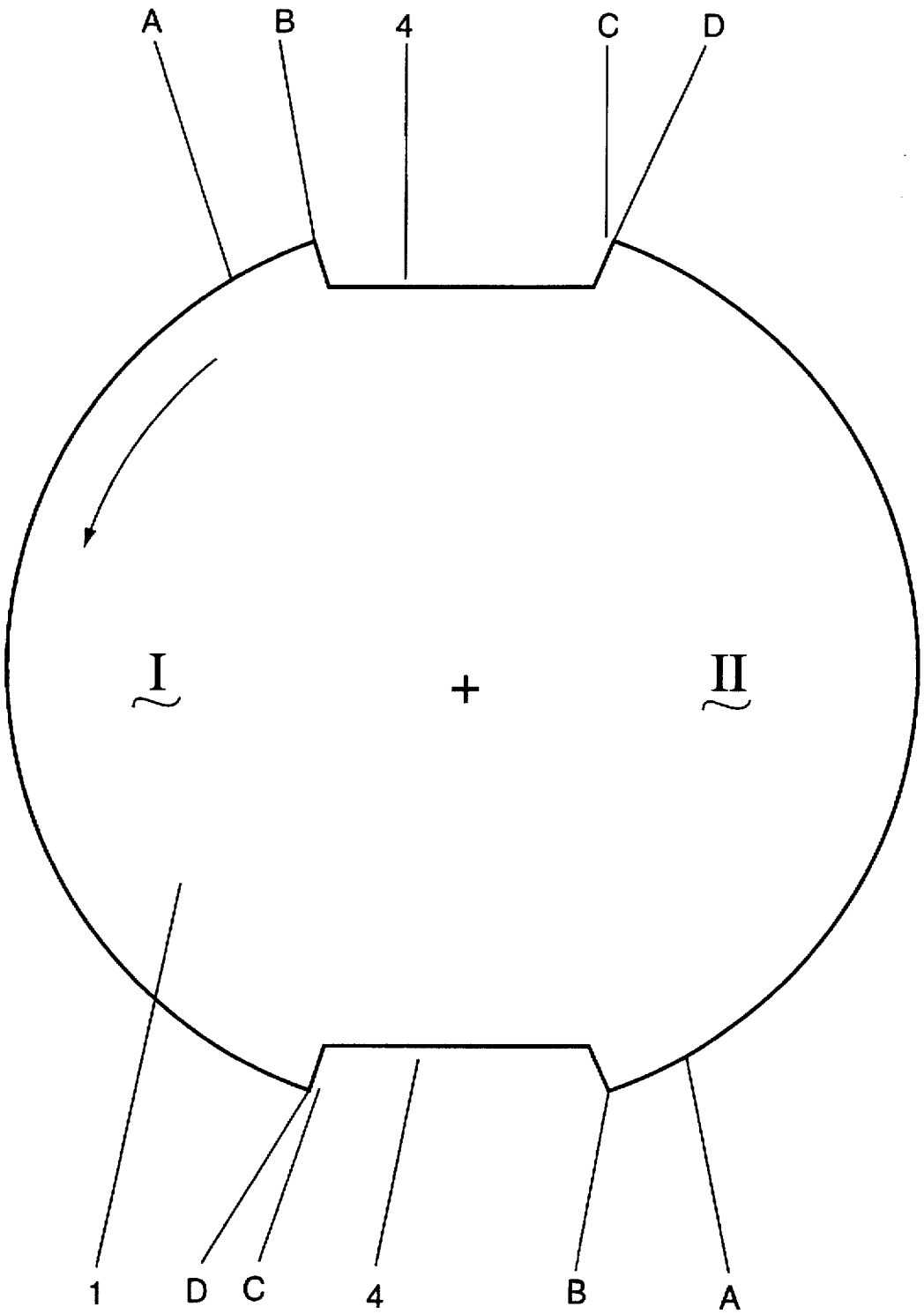
FIG. 4 is a diagrammatic representation of a double-size impression cylinder.

A double-size impression cylinder 1 is illustrated in FIG. 4. The double-size impression cylinder 1 has two sheet-carrying outer surfaces I and II. In a manner similar to the example described above with respect to the blanket cylinder 6, predampening takes place at an angular setting C, the washing device 2 is engaged at the angular setting D, the washing device 2 is disengaged at the angular setting A and, when the outer surface of the impression cylinder 1 is brushed dry, the washing device 2 is engaged at the angular setting D and disengaged at the angular setting B. Since there are two outer surfaces I and II, the outer surfaces I and II should both be in contact with the washing device 2. Preferably, after a full cylinder revolution (during which all the outer surfaces I, II are cleaned), while the cylinder 1 is rotating, the washing device 2 is disengaged from the outer surface I. In this disengaged position, the rotating washing brush 11 of the washing device 2 is wiped. It is subsequently engaged against the outer surface II. After cleaning of the outer surface II, the washing device 2 is also engaged against the outer surface I. During the further rotation of the cylinder 1, the washing device 2 is again disengaged and the rotating washing brush 11 is wiped.

The exemplary embodiment described above constitutes only one design. The outer surfaces I, II or even further outer surfaces (in the case of triple- and quadruple--size cylinders) can likewise be cleaned in an alternating manner. The rotating washing brush 11 is to be wiped in a disengaged position, and preferably after at least one cylinder revolution. A relatively clean washing brush is thus constantly brought into contact with the outer surface I and/or II of the cylinder to be cleaned.

Although shown and described is what is believed to be the most practical and preferred embodiments, it is apparent that departures from specific methods and designs described and shown will suggest themselves to those skilled in the art and may be used without departing from the spirit and scope of the invention. The present invention is not restricted to the particular constructions described and illustrated, but should be construed to cohere with all modifications that may fall within the scope of the appended claims.

What is claimed is:

1. A method for cleaning a rotating cylinder of a rotary printing machine comprising:

engaging and disengaging a washing device with or from the rotating cylinder, the washing device which can be sprayed with at least one of a cleaning fluid and water; and engaging and disengaging the washing device, spraying the roller, and adjusting a rotary speed and a direction of rotation of the roller, based upon an angular position of the rotating cylinder, and whether the washing device is in a washing cycle or a drying cycle, such that the washing device is disengaged at a specified distance, along the circumference of the rotating cylinder, prior to a leading edge of a cylinder gap, such that a wedge of cleaning solution formed in front of a point of contact between the washing device and rotating cylinder is carried by momentum up to the leading edge.

2. The method for cleaning a rotating cylinder according to claim 1, which includes manually or automatically adjusting the angular positions.

3. The method for cleaning a rotating cylinder according to claim 1, which includes defining a first angular position as a position of the rotating cylinder when the washing roller is in front of a first edge of a cylinder gap, a second angular position as a position of the rotating cylinder when the washing roller is in a region of the first edge of the cylinder gap, a third angular position as a position of the rotating cylinder when the washing roller is in a region where a printing sheet ends, and a fourth angular position as a position of the rotating cylinder when the washing roller is in a region of a second edge of the cylinder gap.

4. The method for cleaning a rotating cylinder according to claim 3, which includes spraying the washing roller, which is a washing brush, with a cleaning fluid during the washing cycle when the rotating cylinder is at the first angular position and the washing device is disengaged.

5. The method for cleaning a rotating cylinder according to claim 3, which includes engaging the washing device against the rotating cylinder when the rotating cylinder is at the second angular position during the washing and drying cycle.

6. The method for cleaning a rotating cylinder according to claim 3, which includes disengaging the washing device when the rotating cylinder is at the third angular position during the washing cycle and re-engaging, or leaving it engaged, during the drying cycle.

7. The method for cleaning a rotating cylinder according to claim 3, which includes disengaging the washing device is from the rotating cylinder at the fourth angular position during the washing and drying cycle.

8. The method for cleaning a rotating cylinder according to claim 1, which includes engaging, when the rotating cylinder comprises a multiple-size cylinder, the washing device against a first outer surface of the multiple-size cylinder, depending on the fixed angular setting, and engaging the washing device against a second outer surface of the multiple-size cylinder, and disengaging the washing device in the region, on both first and second outer surfaces, where the printing sheets end.

9. The method for cleaning a rotating cylinder according to claim 1, wherein said washing roller is a rotating washing brush, and the method includes wiping said rotating washing brush based upon an angular position of the rotating cylinder.

10. The method for cleaning a rotating cylinder according to claim 1, which includes rotating a rotating washing brush at a higher circumferential speed than the rotating cylinder.

11. The method for cleaning a rotating cylinder according to claim 3, which includes stopping the rotating cylinder during the drying process while the washing roller is engaged with the rotating cylinder between the third and fourth angular positions, or reversing the direction of rotation of the rotating cylinder.

12. The method for cleaning a rotating cylinder according to claim 3, which includes, when the rotating cylinder comprises a cylinder having flattened portions instead of a cylinder gap, leaving engaged the washing device against the cylinder at the third angular position during washing and during the drying cycle.

13. A method for cleaning a rotating cylinder of a rotary printing machine comprising:

activating a washing device when the cylinder is at a first angular position including spraying at least one of detergent and water onto a washing roller of the washing device, wherein the first angular position corresponds to the position of the cylinder when the washing roller is in front of a first edge of a cylinder gap of the cylinder;

engaging the washing roller with the cylinder when the cylinder is rotated between a second angular position and a third angular position, wherein the second angular position corresponds to the position of the cylinder when the washing roller is at first edge of the cylinder gap and the third angular position corresponds to the position of the cylinder when the washing roller is prior to a second edge of the cylinder gap;

disengaging the washing roller from the cylinder when the cylinder is rotated between the third angular position and a fourth angular position, wherein the fourth angular position corresponds to a position of the cylinder when the washing roller is at the second edge of the cylinder gap, such that a wedge of cleaning solution formed in front of a point of contact between the washing device and rotating cylinder is carried by momentum up to the second edge of the cylinder gap; and drying the cylinder by engaging the washing roller without spraying detergent and water onto the washing roller and rotating the cylinder at increased rotational rates.

14. The method for cleaning a rotating cylinder according to claim 13, which includes manually or automatically adjusting the angular positions.

15. The method for cleaning a rotating cylinder according to claim 13, wherein said washing roller is a rotating brush, and the method includes wiping said rotating washing brush based upon an angular position.

16. A method for cleaning a cylinder of a rotary printing machine comprising:

a washing roller sprayed prior to engagement with a rotating cylinder to be cleaned;

engaging the washing roller with the rotating cylinder when a trailing edge of a cylinder gap has passed under the washing roller;

disengaging the washing roller in a region prior to a leading edge of the cylinder gap, such that a wedge of cleaning solution formed in front of a point of contact between the washing roller and rotating cylinder is carried by momentum up to the leading edge; and drying the rotating cylinder by rotating the washing roller at increased rotational rates and in a direction opposite to the direction in which it was rotated for washing, and engaging the washing roller to the rotating cylinder when the trailing edge of the cylinder gap has passed under the washing roller, and disengaging the washing roller after the point at which it was disengaged when washing but before the leading edge of the cylinder gap.

17. The method for cleaning a rotating cylinder according to claim 16, wherein said washing roller is a rotating brush, and the method includes wiping said rotating washing brush based upon an angular position.

* * * * *